US007246460B1

(12) United States Patent
Brauer

(10) Patent No.: US 7,246,460 B1
(45) Date of Patent: Jul. 24, 2007

(54) METHOD OF QUICK TACTILE RELEASE LOCKING

(76) Inventor: Jeffrey L. Brauer, 230 Waterview Dr., Hendersonville, TN (US) 37205-4236

( * ) Notice: Subject to any disclaimer, the term of this patent is extended or adjusted under 35 U.S.C. 154(b) by 0 days.

(21) Appl. No.: 11/009,289

(22) Filed: Dec. 10, 2004

Related U.S. Application Data

(60) Continuation of application No. 10/655,796, filed on Sep. 5, 2003, now Pat. No. 6,889,460, which is a division of application No. 10/058,255, filed on Jan. 25, 2002, now Pat. No. 6,655,067.

(51) Int. Cl.
*F41A 17/04* (2006.01)

(52) U.S. Cl. ..... 42/70.11; 70/465

(58) Field of Classification Search ..... 70/289, 70/290, 465, 125, 126, 130, 133; 251/296; 42/70.11
See application file for complete search history.

(56) References Cited

U.S. PATENT DOCUMENTS

| | | | | | |
|---|---|---|---|---|---|
| 393,305 | A | * | 11/1888 | Misner et al. | 16/374 |
| 1,264,814 | A | * | 4/1918 | Kornstein | 70/116 |
| 1,483,993 | A | * | 2/1924 | Sprowies et al. | |
| 1,649,724 | A | * | 11/1927 | Olinger | 70/312 |
| 1,673,468 | A | * | 6/1928 | Palinkas | 70/120 |
| 2,121,060 | A | * | 6/1938 | Tibbetts | |
| 2,393,465 | A | * | 1/1946 | Gray | |
| 3,206,238 | A | * | 9/1965 | Speight et al. | 292/195 |
| 3,821,885 | A | * | 7/1974 | Gerry | 70/298 |
| 4,327,566 | A | | 5/1982 | Ling | |
| 4,509,281 | A | * | 4/1985 | Dreiling et al. | 42/70.07 |
| 4,524,592 | A | * | 6/1985 | Saitoh | 70/287 |
| 4,671,084 | A | * | 6/1987 | Lin | 70/25 |
| 4,866,958 | A | * | 9/1989 | Bretl et al. | 70/25 |
| 5,090,148 | A | | 2/1992 | Brooks | |
| 5,138,786 | A | * | 8/1992 | Fischer | 42/70.11 |
| 5,161,396 | A | * | 11/1992 | Loeff | 70/63 |
| 5,189,894 | A | * | 3/1993 | Buck | 70/63 |
| 5,392,552 | A | * | 2/1995 | McCarthy et al. | 42/70.07 |
| 5,419,068 | A | * | 5/1995 | Pages et al. | 42/70.07 |
| 5,535,605 | A | * | 7/1996 | Werner | 42/70.06 |
| 5,561,935 | A | * | 10/1996 | McCarthy et al. | 42/70.07 |
| 5,720,193 | A | * | 2/1998 | Dick | 70/298 |
| D393,305 | S | | 4/1998 | Misner et al. | 22/108 |

(Continued)

FOREIGN PATENT DOCUMENTS

| | | | | |
|---|---|---|---|---|
| AT | 169436 | * | 11/1951 | 70/312 |

(Continued)

*Primary Examiner*—Stephen M. Johnson
(74) *Attorney, Agent, or Firm*—Waddey & Patterson, PC; Phillip E. Walker

(57) ABSTRACT

The present invention provides a locking device designed to open by tactile manipulation, without visual confirmation, of the locking combination. This device comprises a housing, a securing element, and a plurality of tumbling levers located inside the housing. Each tumbling lever is located in a plane of movement parallel to other planes of movements of the other tumbling levers. Also, each tumbling lever includes a tactile engagement surface and engages the securing element so that movement of a tactile engagement surface disengages the corresponding tumbling lever from the securing element.

10 Claims, 7 Drawing Sheets

U.S. PATENT DOCUMENTS

| | | | | | |
|---|---|---|---|---|---|
| 5,749,166 | A | * | 5/1998 | Brooks | 42/70.11 |
| 5,782,113 | A | * | 7/1998 | Chen | 70/312 |
| 5,899,098 | A | * | 5/1999 | Carter et al. | 70/25 |
| 5,918,402 | A | * | 7/1999 | Weinraub | 42/70.07 |
| 5,946,841 | A | * | 9/1999 | Roper | 42/70.11 |
| 6,009,654 | A | * | 1/2000 | Williams et al. | 42/70.11 |
| 6,145,355 | A | * | 11/2000 | Burleigh et al. | 70/298 |

FOREIGN PATENT DOCUMENTS

| | | | | |
|---|---|---|---|---|
| FR | 802998 | * | 9/1936 | 70/288 |
| GB | 2 180 587 A | * | 4/1987 | |
| IT | 487888 | * | 12/1953 | 70/312 |
| SE | 102744 | * | 10/1941 | 70/288 |

* cited by examiner

METHOD OF QUICK TACTILE RELEASE LOCKING

APPLICATION FOR UNITED STATES LETTERS PATENT

This application is a continuation application claiming benefit of U.S. patent application Ser. No. 10/655,796 filed Sep. 5, 2003, entitled "Quick Tactile Release Lock", now U.S. Pat. No. 6,889,460, which is a divisional claiming benefit of U.S. patent application Ser. No. 10/058,255, filed on Jan. 25, 2002, now U.S. Pat. No. 6,655,067, issued on Dec. 2, 2003, entitled "Quick Tactile Release Lock", both of which are hereby incorporated by reference in their entireties.

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

1. Field of the Invention

The present invention relates generally to a locking mechanism adapted to be opened by the use of a quick tactile releasing combination.

2. Description of the Prior Art

Security in this day and age is a necessity. Most items the average citizen possesses require security measures to protect these items from unscrupulous persons. The desire to protect one's possessions necessitates the use of locks. Most conventional locks require the use of use either a key or an alpha-numeric combination in order to open the locks.

Keyed locks require the maintenance of the key itself. Without the key, the lock does not open. Obviously, keys can be lost, broken, or stolen. All of these circumstances defeat the purpose of using a lock to secure items so that only the owner can access the items.

Combination locks use a different locking philosophy to avoid the pitfalls of locks requiring keys to facilitate their operation. The conventional combination lock requires a user to memorize alpha-numeric characters and to visually confirm the alpha-numeric combination entered on the lock in order to release the lock from the items it secures. This requires a line of sight to the alpha-numeric controls on the lock, comprehension of the alpha-numeric characters on the lock, and adequate light in order to read the alpha-numeric characters on the lock. Without this visual confirmation, a user of a conventional combination lock will fail to enter the correct alpha-numeric combination and be unable to open the lock. Thus, there is a need in the art for a tactile releasing lock adapted to open without visual confirmation of the locking combination or the use of an independent key.

With the afore mentioned focus on security, the number of households having firearms as a means of protection has increased. The inherit danger of firearm necessitates a safe apparatus in which to secure a firearm from children and other unauthorized users. Also, since the need for a firearm around the home usually arises at night when the probability of potential intruders increases, a proper firearm lock needs to have releasing features that operate in the absences of adequate light or in situations when the view of the lock is obstructed.

The use of a lock accessed by a key to secure a firearm negates one of the prime purposes of using a lock to secure a firearm—to protect unauthorized access to and use of the firearm. For example, if the key to a lock is kept in the home, there is a potential risk of an unauthorized person, especially a child, gaining access to the firearm by discovering the location of both the locked firearm and the key. Also, the use of an independent key to release a lock runs a high risk of losing the independent key, which is the only method by which to open the lock. Thus, the potential risk of unauthorized access to a keyed lock combined with the probability of misplacement of the key that opens the lock makes the use of a keyed lock to secure a firearm undesirable.

A conventional combination lock is also undesirable to secure a firearm since visual confirmation of the lock is needed to correctly input the combination of alpha-numeric characters required to open such a lock. For example, U.S. Pat. No. 5,720,193 issued to Dick is a typical push button firearm lock. The Dick lock requires a user to press the correct combination of alpha-numeric characters associated with numerous release buttons. The correct sequence of alpha-numeric buttons must be activated in order to release the Dick lock. This alpha-numeric combination entry requires a user to read and comprehend either a series of alpha-numeric characters or other symbols. Without adequate lighting or a line of sight to the lock this task is very difficult, if not impossible, to perform.

U.S. Pat. No. D393,305 issued to Mizner is a typical combination lock operated through the use of rotational dials with numerical indices as the releasing mechanisms for the lock. A user of the Mizner lock must visually confirm the correct numeric combination in order to open the lock. Once again, this requires a line of sight to the lock and adequate lighting to read the characters on the releasing mechanisms.

Other firearm locks use different forms of alpha-numeric opening mechanisms in order to release the locking apparatuses. No other lock, however, operates solely through tactile manipulation.

Once again with the afore mentioned focus on security, one needed feature of a proper firearm lock used in households is the rapid release of the lock from the firearm. This requirement stems from the urgency required in situations when a firearm is used in the home. Namely, a firearm lock that requires any appreciable amount of time to open increases the potential danger to the homeowner. This increase occurs due to the rapid unfolding of events during a burglary of the home when precious seconds can mean life or death.

Thus, there is a need in the art for a quick tactile releasing lock adapted to secure a firearm and to open without visual confirmation of the locking combination or the use of an independent key.

SUMMARY OF THE INVENTION

The present invention provides a locking device designed to open by tactile manipulation without visual confirmation of the locking combination. This device comprises a housing, a securing element, and a plurality of tumbling levers located inside the housing. Each tumbling lever is located in a plane of movement parallel to other planes of movements of the other tumbling levers. Also, each tumbling lever includes a tactile engagement surface and each tumbling lever engages the securing element so that movement of a tactile engagement surface disengages the corresponding tumbling lever from the securing element.

A method for releasing an item from a locking device is also disclosed. This method includes steps of providing a tactile releasing lock engaging the item. The method teaches manipulating, without visual confirmation, the tactile releasing lock to free the item. The method teaches that the correct manipulation of tactical releasing surfaces on the locking device releases the locking device from the item. The method also includes the use of a releasing mechanism which separates the tactile releasing lock from an item it secures once the correct manipulation of the tactile releasing surfaces on the releasing lock has been performed.

It is a general object of the present invention to provide a quick release tactile locking device adapted to open without visual confirmation of the releasing combination.

Another objective of this quick tactile release lock is to allow an owner of a firearm to have peace of mind that the firearm is secure, yet have the ability to rapidly operate the locking device, without visual confirmation, to release the firearm secured by the locking device.

Further, it is desired that the operation of this lock allows quick access to the normal firing position of a firearm. As a result, another object of the present locking invention is to conform the design of the lock to the shape of a firearm and allow manipulation of the tactile releasing surfaces and separation of the lock from the firearm while the operator's hands are near the normal firing position used to discharge a firearm. This facilitates an expedient deployment of a firearm.

Still another object of this invention is to provide a method in which a locking device opens without requiring visual confirmation of the releasing combination.

Numerous other objects, features and advantages of the present invention will be readily apparent to those skilled in the art, upon a reading of the following disclosure, when taken in conjunction with the accompanying drawings.

BRIEF DESCRIPTION OF THE DRAWINGS

FIG. 7 differs from FIG. 6 in that FIG. 7 shows the connection section of the securing element engaged with the tumbling levers.

DETAILED DESCRIPTION OF THE PREFERRED EMBODIMENTS

Figure 1:
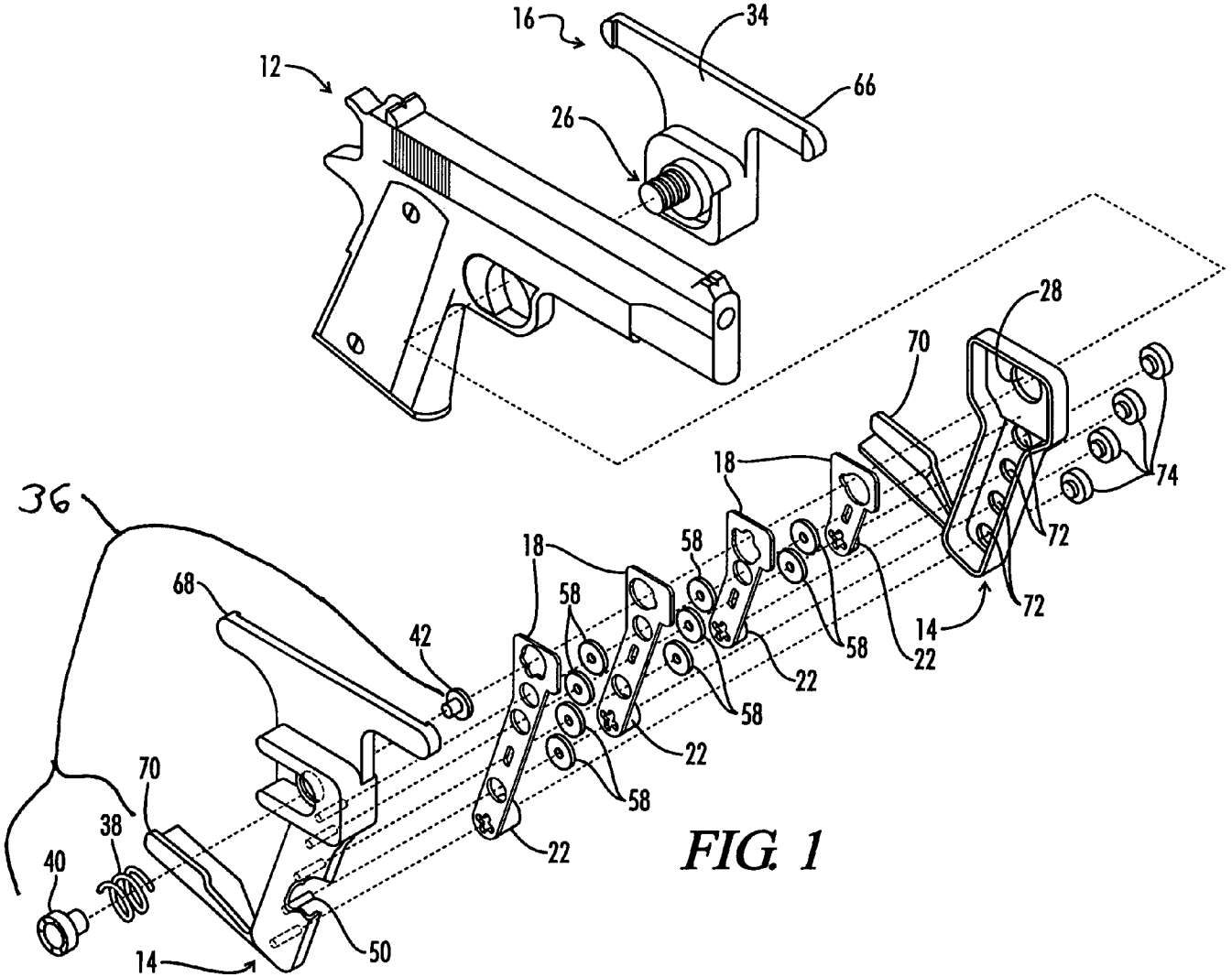
FIG. 1 is an expanded perspective view of the locking device.

Referring now to FIG. 1, the locking device of the present invention is shown and is generally designated by the numeral 10. The locking device 10 is a device for securing an item 12. The locking device 10 comprises a housing 14, a securing element 16 and a plurality of tumbling levers 18 located inside the housing 14. Each tumbling lever 18 is located in a plane of movement 20 parallel to the other planes of movement 20 of the other tumbling levers 18 and each tumbling lever 18 includes a tactile engagement surface 22. Each tumbling lever 18 engages the securing element 16 such that the interaction between each tumbling lever 18 and the securing element 16 maintains the locking device 10 in a secured and locked position. The locking device 10 is designed so that movement of each tumbling lever 18 disengages that tumbling lever 18 from the securing element 16, thereby allowing the locking device 10 to release the item 12 it secures.

The housing 14 has access openings 72 through which the tactile engagement surfaces 22 protrude. The housing 14 has the number of access openings 72 to correspond to the number of tactile engagement surfaces 22 on tumbling levers 18. One access opening 72 corresponds with each tumbling lever 18 and allows a human user of the locking device 10 to manipulate the tactile engagement surfaces 22 to disengage the tumbling lever 18 from the securing element 16. The disengagement is the adjustment of the tumbling levers 18 to align the detent portion 24 of the tumbling levers 18 with the locking discs 30 of the securing element 16. This alignment releases the locking device 10 from the item 12.

In the locked position, the securing element 16 penetrates the housing 14 and engages the tumbling levers 18. Each tumbling lever 18 includes a detent portion 24 engaging the securing element 16 when the locking device 10 is in the locked position. Manipulation of the tactile engagement surface 22 of an associated tumbling lever 18 repositions that tumbling lever 18 and thereby disengages the detent portion 24 of that tumbling lever 18 from the securing element 16.

The securing element 16, which can also be described as a lock bolt 16, includes a connection section 26. The lock bolt opening 28 in the housing 14 is geometrically shaped to accept the connection section 26 of the securing element 16, including the locking discs 30 on the connection section 26 of the securing element 16. Once the connection section 26 penetrates the lock bolt opening 28, the detent portion 24 of each tumbling lever 18 engages the connection section 26 of the securing element 16. In a preferred embodiment of the invention, the connection section 26 of the securing element 16 has four locking discs 30, indicated as 30A, 30B, 30C, and 30D in FIG. 6. In alternate embodiments, the number of locking discs 3C will increase as the need for incorrect combinations of the lock 10 will increase as well as the physical capacity of the housing 14 increases. Also, the locking discs 30 are separated by spacing stems 31, indicated as the 31A, 31B, 31C, and 31D.

The engagement between the locking discs 30, spacing stems 31, and the detent portions 24 of each tumbling lever 18 controls the securing and releasing characteristics of the locking device 10. For example, in a preferred embodiment, the locking device 10 includes four tumbling levers 18, indicated as 18A, 18B, 18C, and 18D, in FIGS. 6 and 7. In this preferred embodiment, the number of tumbling levers 18 correspond to the number of locking discs 30. Also, the geometric configurations of the locking discs 30 correspond to the geometric configurations of the detent portions 24 of the tumbling levers 18. In order for securing element 16 to fully penetrate the locked bolt opening 28 in the housing 14 and secure the item 12, the connection section 26 of the securing element 16 must pass through the detent portions 24 on each of the tumbling levers 18.

As connection section 26 begins to penetrate the lock bolt opening 28, locking disc 30D is the first locking disc 30 to engage a tumbling lever 18. In order for locking device 10 to secure the item 12, locking disc 30D must pass through each of the detent portions 24 of the tumbling levers 18. This requirement necessitates that detent portions 24A, 24B, 24C, and 24D, shown in FIG. 6, each have both the geometrical configuration and alignment to allow locking disc 30D to penetrate into the housing 14. In similar fashion, the next locking disc 30 to penetrate the lock bolt opening 28 is locking disc 30C. Locking disc 30C must pass through detent 24A, 24B, and 24C on tumbling levers 18A, 18B, and 18C, respectively. Once again, the geometric configuration and alignment of detent portion 24A, 24B, and 24C allow locking disc 30C to penetrate the housing 14 when the locking device 10 is correctly manipulated during the securement of the item 12.

Similarly, locking disc 30B must pass through detent portions 24A and 24B located on tumbling levers 18A and 18B, respectively. This necessitates detent portions 24A and 24B to be geometrically configured and aligned to allow locking disc 30B to pass. Finally, locking disc 30A must pass through detent portion 24A on tumbling lever 18A to complete the engagement of the securing element 16 and the housing 14.

Portions of this engagement will concurrently transpire as the connection section 26 of the securing element 16 penetrates the lock bolt opening 28. This engagement is complete once each locking disc 30 passes through the associated detent portion 24 of the corresponding tumbling lever 18. For example, locking disc 30A will pass through detent portion 24A of tumbling lever 18A as locking disc 30D passes through detent portion 24D of tumbling lever 18D. Concurrently, locking disc 30B will pass through detent portion 24B of tumbling lever 18B while locking disc 30C passes through detent portion 24C of tumbling lever 18C. In essence, all locking discs 30 will pass through the associated detent portions 24, concurrently.

Figure 6:
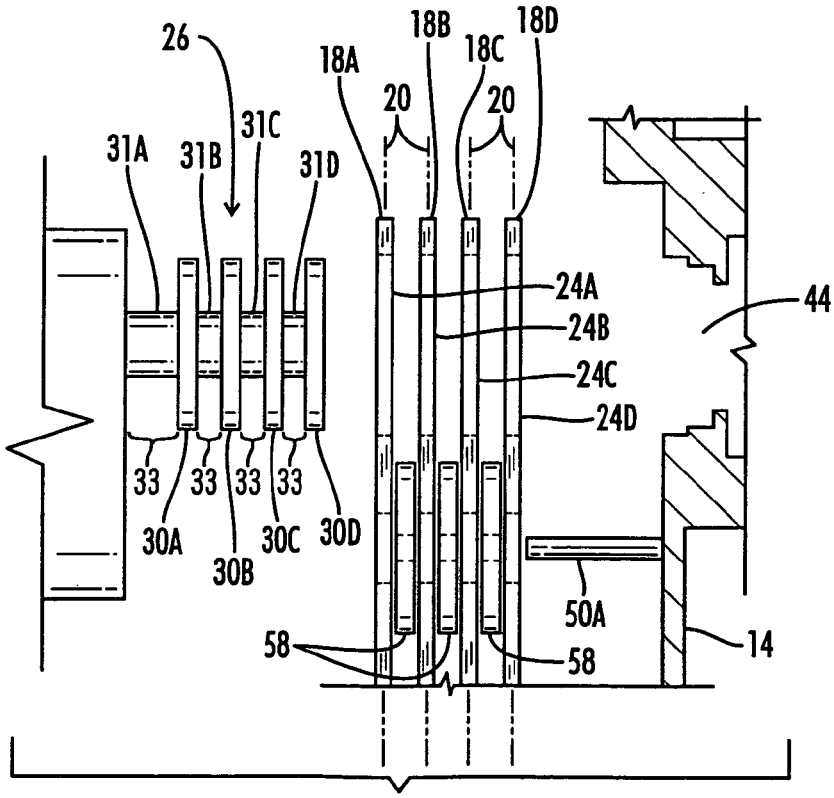
FIG. 6 is a partial elevation view of the connection section of the securing element aligned with the detent portions of the tumbling levers. This figure is shown with the connection section of the securing element disengaged from the tumbling levers.
Figure 7:
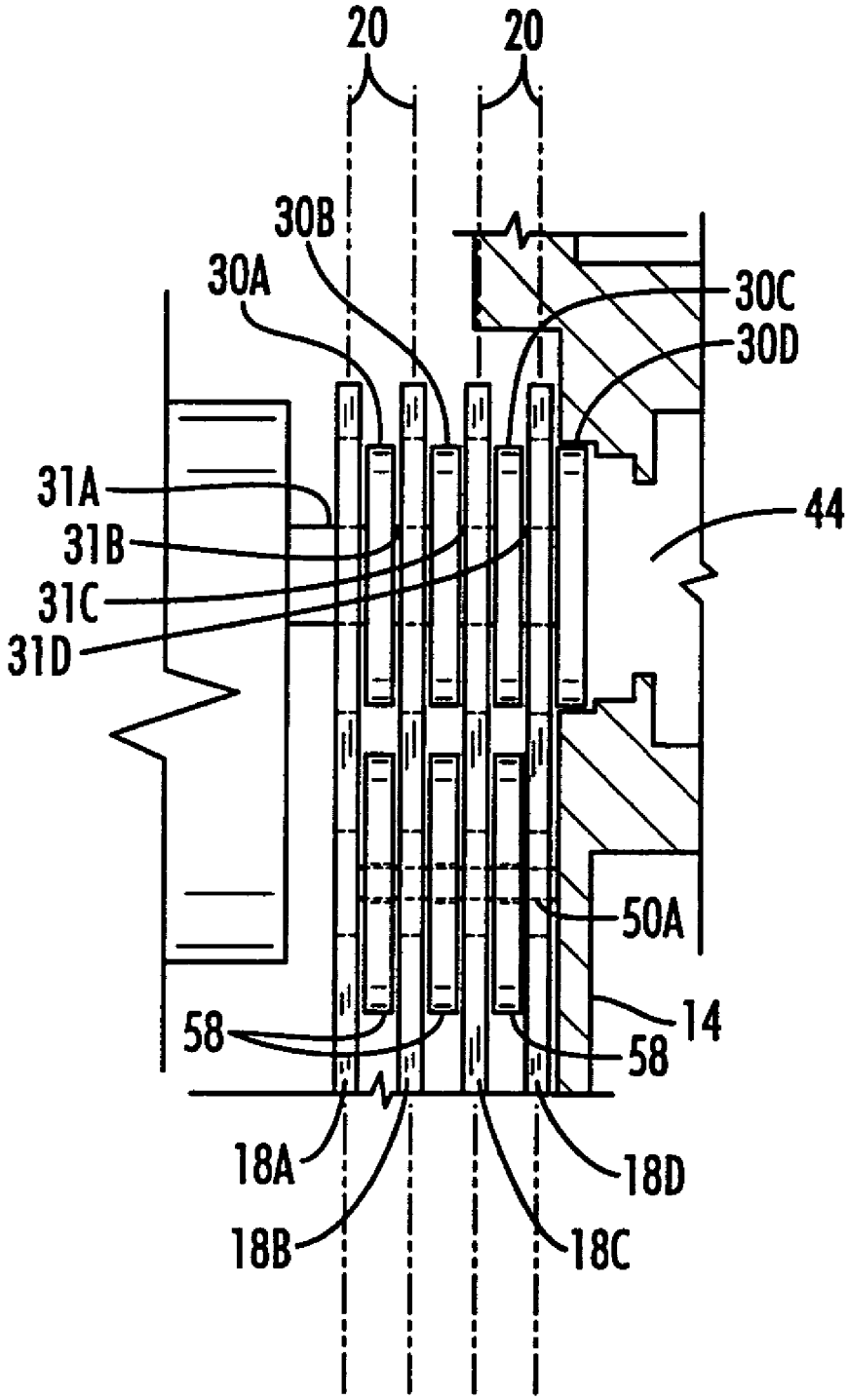
FIG. 7 is a partial elevation view of the connection section of the securing element aligned with the detent portions of the tumbling levers.
Figure 8:
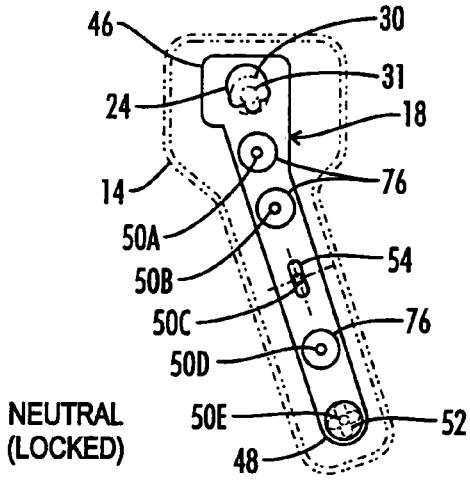
FIG. 8 is a detailed view of one of the tumbling levers when the tactile engagement surface is in the neutral and locked position.
Figure 9:
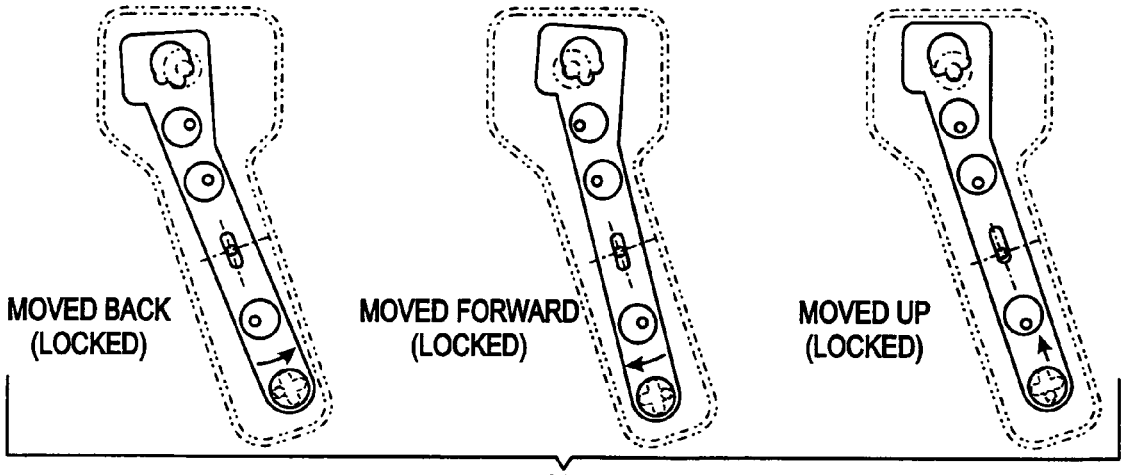
FIG. 9 is a view of the tumbling lever from FIG. 8 adjusted in three of the four distinct directions. The view shows the interaction between the pivot stems, a locking disc, and a tumbling lever when the tactile engagement surface is moved incorrectly in an attempt to unlock that tumbling lever. As seen in the view, movement in any of these three incorrect directions fails to unlock the tumbling lever.

As seen in FIG. 6, in a preferred embodiment, the four spacing stems 31, indicated as 31A, 31B, 31C, and 31D, create spacing intervals 33 between the locking discs 30. For example, spacing stem 31D creates spacing interval 33 between locking disc 30C and 30D. As seen in FIG. 7, in the locked position tumbling lever 18D, specifically its detent portion 24D, encompasses spacing stem 31D located between locking disc 30C and 30D. Since the spacing stems 31 have a smaller circumference than the locking discs 30, the detent portions 24 have a range of movement within the plane of movement 20 in which each tumbling lever 18 is located when the connection section 26 fully penetrates the housing 14.

This range of movement of the tumbling levers 18 within the housing 14 creates an engagement between the locking disc 30 and the detent portions 24 when an incorrect combination of the locking device 10 is used in an attempt to remove the securing element 16 from the housing 14.

Figure 10:
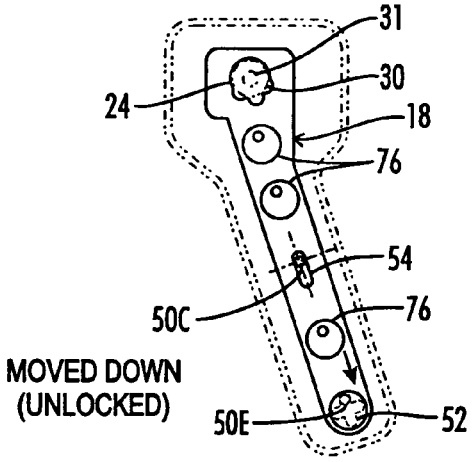
FIG. 10 is a view of the tumbling lever from FIG. 8 adjusted in the correct direction to align the detent portion of the tumbling lever and the locking disc, thereby unlocking that tumbling lever.
Figure 11:
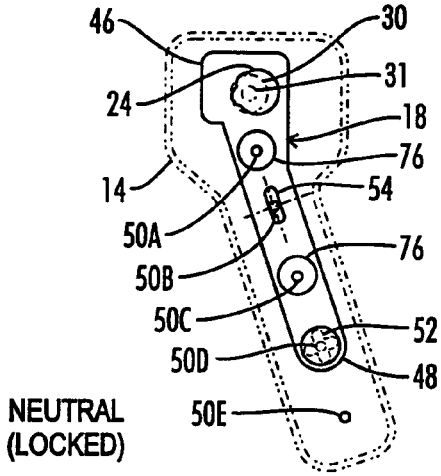
FIG. 11 is a detailed view of another tumbling lever when the tactile engagement surface is in the neutral and locked position.
Figure 12:
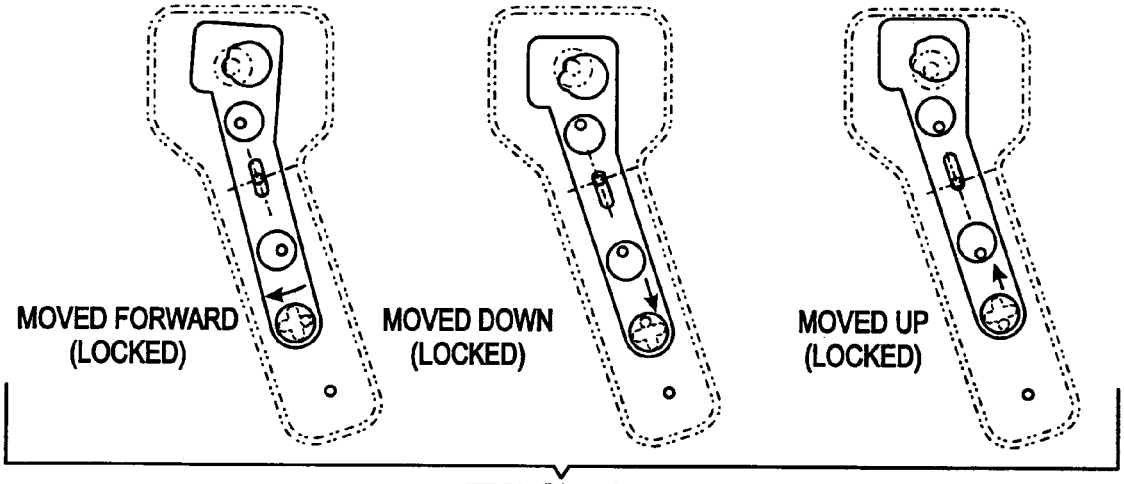
FIG. 12 is a view of the tumbling lever from FIG. 11 adjusted in three of the four distinct directions in an attempt to unlock that tumbling lever. As seen in the view, movement in any of these three incorrect directions fails to unlock the tumbling lever.
Figure 13:
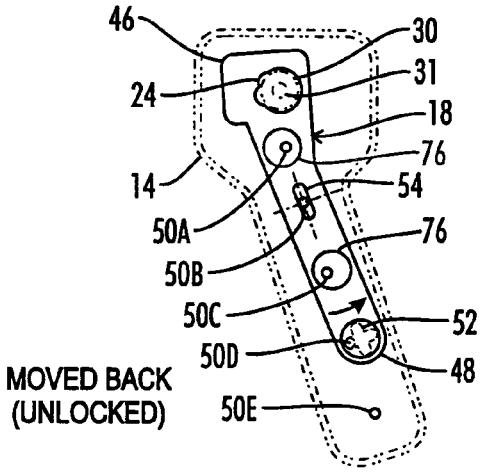
FIG. 13 is a view of the tumbling lever from FIG. 11 adjusted in the correct direction to align the detent portion of the tumbling lever and the locking disc, thereby unlocking that tumbling lever.

For example, locking discs 30 are geometrically designed to pass through detent portions 24 on tumbling levers 18 only when the detent portions 24 are in the correct alignment as seen in FIGS. 10 and 13. As previously mentioned, when locking device 10 is in its secured position, detent portions 24 encompass spacing stems 31, which separate locking discs 30. When the tactile engagement surfaces 22 of the tumbling levers 18 are manipulated, the alignment of the locking discs 30 and the detent portions 24 of the tumbling levers 18 are reconfigured. This realignment restricts the removal of the connection section 26 of the securing element 16 from the housing 14. This restriction occurs due to the fact that once the tumbling levers 18 are adjusted away from their unlocked position, the detent portions 24 of the tumbling levers 18 shift within the plane of movement 20 to a position that restricts the movement of the locking discs 30 from passing through the detent portions 24. As seen in FIGS. 8, 9, 11, and 12, this causes the locking disc 30 to engage detent portions 24 of the tumbling levers 18 when a user attempts to remove the securing element 16 without manipulating the tumbling levers 18 into the correct releasing combination.

Figure 2:
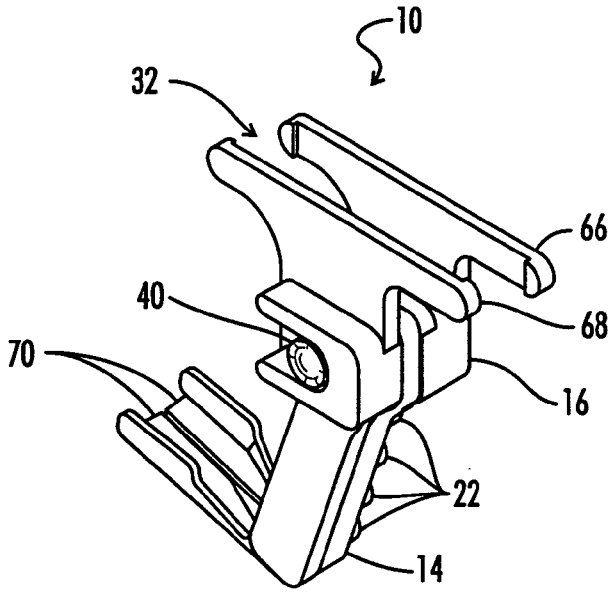
FIG. 2 is a perspective view showing an embodiment of the locking device without an item secured within its elements.
Figure 3:
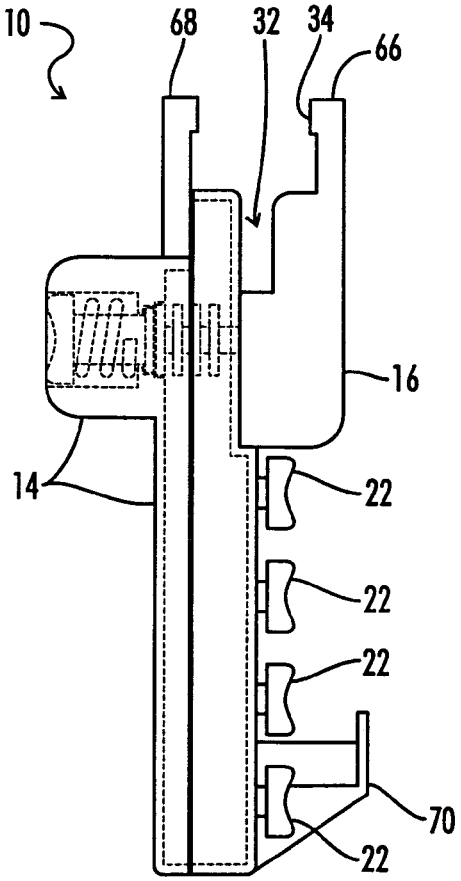
FIG. 3 is a front elevation view of the locking device shown without an element secured.

When the securing element 16 penetrates the lock bolt opening 28 located in the housing 14, an area of containment 32 is created between the securing element 16 and the housing 14, as seen in FIGS. 2 and 3. This area of containment 32 is used to secure the item 12. Specifically, the securing element 16 includes a holding area 34 that is adapted to secure the item 12 between the securing element 16 and the housing 14. Holding area 34 and housing 14 engage the item 12 once the item 12 is placed between the securing element 16 and the housing 14 and once the connection section 26 fully penetrates the housing 14.

Figure 14:
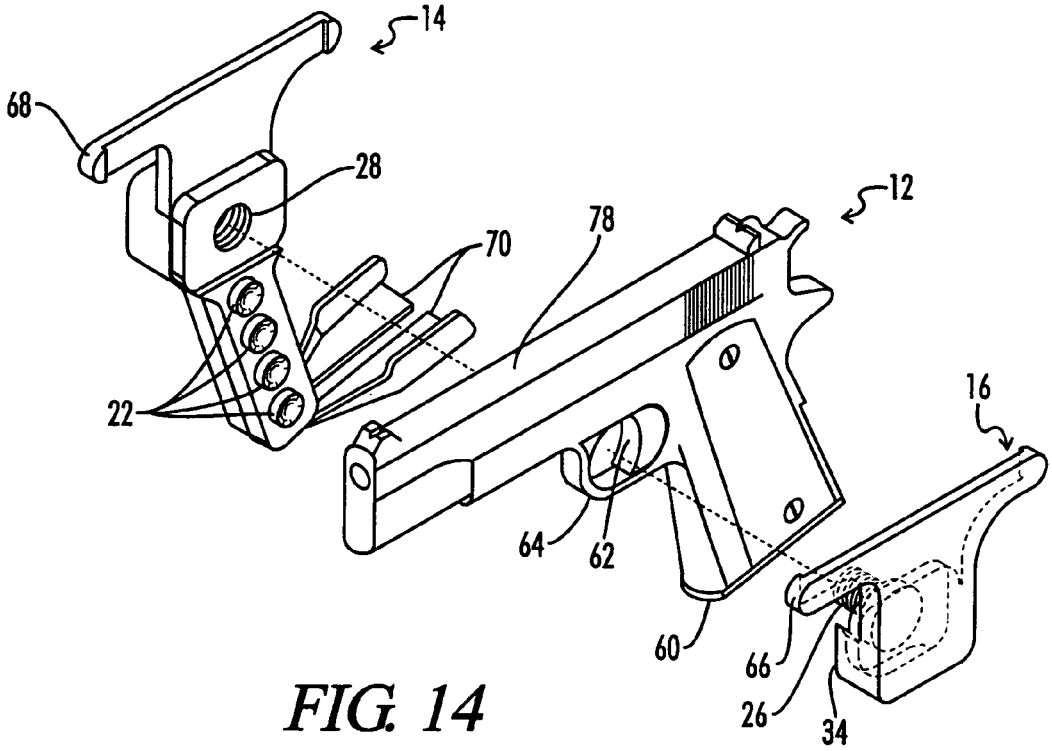
FIG. 14 is a perspective view from the securing element side of the locking device showing the alignment of the securing element, the item secured, and the housing.
Figure 15:
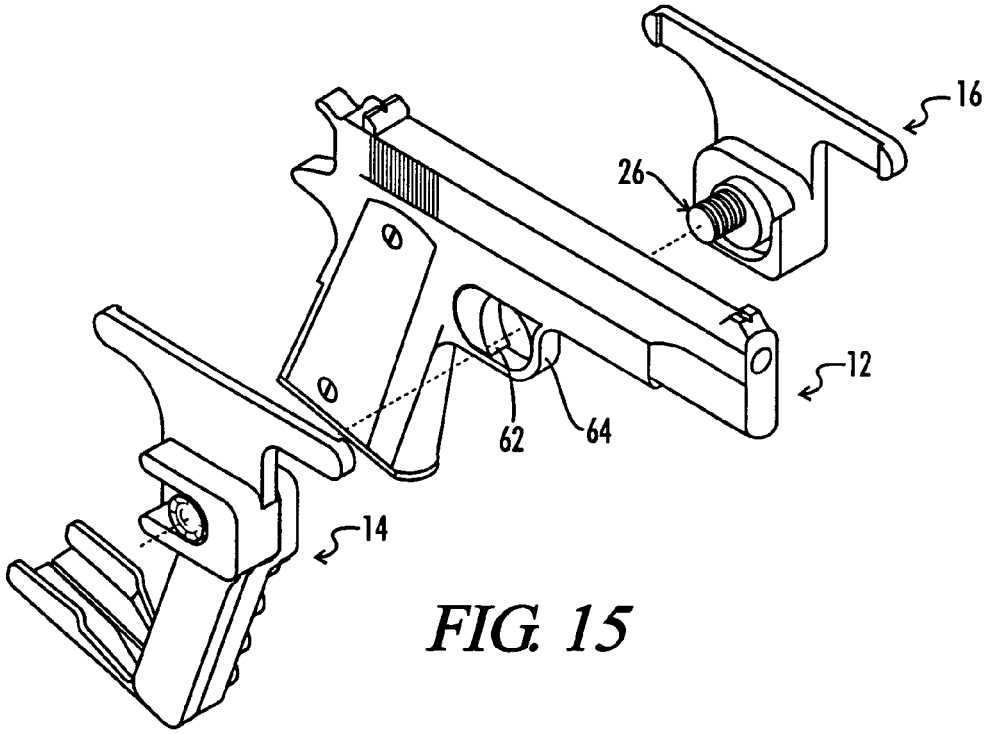
FIG. 15 is a perspective view from the housing side of the locking device showing the alignment of the securing element, the item secured, and the housing.

As seen in FIGS. 14 and 15, a preferred embodiment of the design, of the securing element 16 and the housing 14 facilitate the securement of a firearm 12, also called the item 12. However, the external configuration of both the securing element 16 and the housing 14 can easily be adapted to secure other items 12 including, but not limited to, steering wheels, bicycles, and gymnasium lockers.

As seen in FIG. 1, the releasing mechanism 36 comprises a spring 38, a button 40 and a contact portion 42. In a preferred embodiment, the releasing mechanism 36 is attached to and penetrates the housing 14 in order to engage the securing element 16 once the securing element 16 penetrates the housing 14. Specifically, the contact portion 42 of the releasing mechanism 36 engages the connection section 26 of the securing element 16. Namely, locking disc 30D is the portion of the connection section 26 that engages the releasing mechanism 36. When the connection section 26 totally penetrates the housing 14, the engagement between the locking disc 30D and the contact portion 42 occurs in recessed area 44. The releasing mechanism 36 is adapted to separate the securing element 16 from the housing 14 after the correct movement of each tumbling lever 18 allows the locking discs 30 to pass through the detent portions 24 of the tumbling levers 18.

Figure 4:
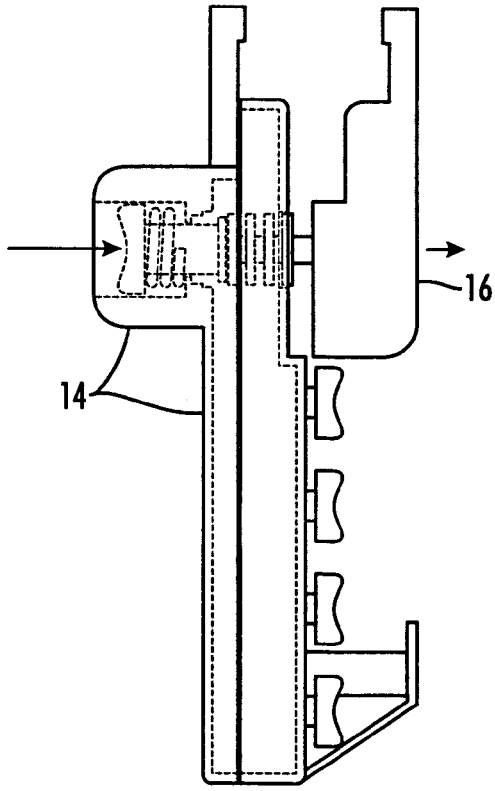
FIG. 4 is a front elevation view of the locking device showing the releasing mechanism depressed and ejecting the securing element.

Once the correct manipulation of the tumbling levers 18 aligns the detent portions 24 of the tumbling levers 18 and the locking discs 30, a user of the locking device 10 presses the button 40 of the releasing mechanism 36. This action causes the contact portion 42 to force the securing element 16 out of the housing 14, thereby releasing item 12 from the area of containment 32. Please see FIG. 4. The spring 38 then returns the button 40 to its original position. Both the spring 38 and the button 40 are located on the housing 14 opposite from the location of the lock bolt opening 28 in the housing 14 that receives the connection section 26 of the securing element 16.

The plurality of tumbling levers 18 located inside the housing 14 can also be described as having a proximal end 46 and a distal end 48. The proximal end 46 of each tumbling lever 18 contains the detent portion 24 which engages the connection section 26 of securing element 16. The distal end 48 of each tumbling lever 18 contains the tactile engagement surface 22 so that tactile manipulation of the distal end 48 disengages the proximal end 46. The disengagement is facilitated by the alignment of the detent portion 24 of the proximal end 46 of the tumbling lever 18 with the locking discs 30 of the connection section 26 of the securing element 16. This alignment allows the releasement of the securing element 16 from the housing 14, thus opening the locking device 10.

Tactile manipulation of the distal ends 48 of the tumbling levers 18 aligns the proximal ends 46 of the tumbling levers 18 with the locking discs 30 of the securing element 16. This alignment allows the releasing mechanisms 36 engaging the security element 16 to discharge the securing element 16 from the housing 14.

Figure 5:
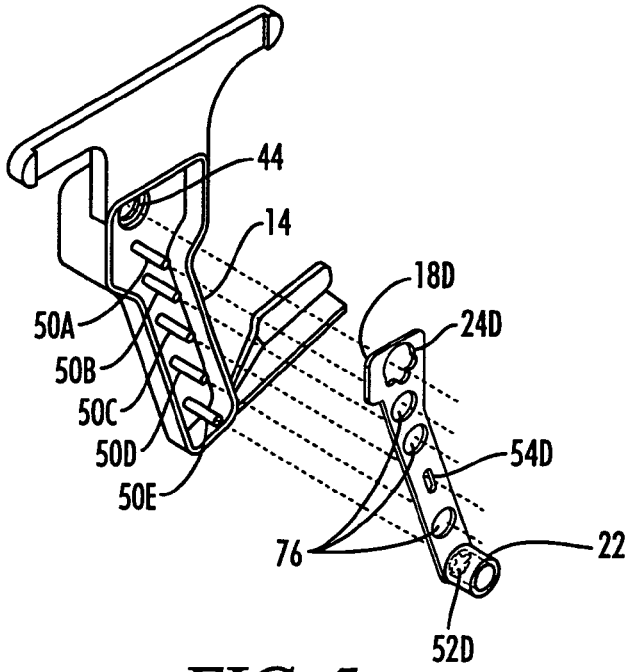
FIG. 5 is an expanded perspective view of the alignment of one of the tumbling levers, the pivot stems and a portion of the housing.

The housing 14 includes plurality of pivot stems 50 used to control the movement of the tumbling levers 18 within the housing 14. In a preferred embodiment, the locking device 10 has five pivot stems 50 attached to the housing 14. The movement of each tumbling lever 18 is restricted by the pivot stems 50 in conjunction with a pivot opening 54 and directional control opening 52 located on each tumbling lever 18. The pivot stems 50, indicated as 50A, 50B, 50C, 50D, and 50E in FIG. 5, are designed to assist in the control the movement of the tumbling levers 18 by restricting the movement of the tumbling levers 18 to either a planer slide or a planer rotation within the plane of movement 20 that each tumbling lever 18 is located.

The direction of movement of each tumbling lever 18 is restricted by providing each tumbling lever 18 with a pivot opening 54 to interact with a pivot stem 50. The pivot opening 54 is an elongated opening that runs parallel to the longest length of each tumbling lever 18. Each pivot opening 54 is designed to accept a pivot stem 50 and allow planer movement in directions parallel to the length of the tumbling lever 18 on which the pivot opening 54 is located. Each pivot opening 54 also allows rotation of the tumbling lever 18 with in the plane of movement 20 about pivot stem 50. Please see FIGS. 8, 9, 10, 11, 12 and 13.

For example, in a preferred embodiment of the invention the pivot opening 54 on each tumbling lever 18 accepts one of the pivot stems 50 while the directional control opening 52 on each tumbling lever 18 accepts a different pivot stem 50. As seen in FIG. 5, pivot stem 50E penetrates through directional control opening 52D on tumbling lever 18D while pivot stem 50C penetrates through pivot opening 54D on tumbling lever 18D.

It is the design and interaction of the pivot stem 50 and the pivot opening 54 that restricts the movement of the tumbling lever 18 about the pivot stem 50 within the plane of movement 20 associated with each tumbling lever 18. For example, when the tactile engagement surface 22 is manipulated in one of the longitudinal directions of the tumbling lever 18, the tumbling lever 18 moves in that corresponding direction. This longitudinal movement is allowed since the pivot opening 54 traverses the tumbling lever 18 along the longitudinal length of tumbling lever 18 and pivot stem 50 is geometrical configured to correspond to the latitudinal width of pivot opening 54 on tumbling lever 18. In a preferred embodiment, pivot opening 54 is approximately one half (½) inch in longitudinal length. It is this longitudinal length of the pivot opening 54 that allows tumbling lever 18 to slide in plane of movement 20. Please see FIGS. 9, 10, 12, and 13.

However, when the tactile engagement surface 22 of a tumbling lever 18 is manipulated to move the tumbling lever 18 in a lateral direction within the plane of movement 20, the pivot stem 50 and the pivot opening 54 restrict the movement of the tumbling lever 18 to a partial rotational movement about the pivot stem 50 within that plane of movement 20. Partial rotational movement is accomplished through the interaction of pivot stem 50 and pivot opening 54. Since pivot stem 50 geometrically conforms to the width of the pivot opening 54, the edges of pivot opening 54 abut pivot stem 50. This interaction restricts the lateral movement of tumbling lever 18 within the plane of movement 20 and only allows a rotational movement of tumbling lever 18 when the tactile engagement service 22 is moved laterally within the plane of movement 20. Since tumbling lever 18 is not permanently fixed by any other point within the plane of movement 20, tumbling lever 18 is allowed to rotate about pivot stem 50.

This restriction on the direction of movement of the tumbling lever 18 by pivot stem 50 and pivot opening 54 limits the direction of movement of the detent portion 24 of each tumbling lever 18. For example, if the tactile engagement 22 is moved in a longitudinal direction, the pivot stem 50 and the pivot opening 54 of the tumbling lever 18 restricts the tumbling lever 18 to movement in that same longitudinal direction. This in turn moves the detent 24 of the associated tumbling lever 18 in the same longitudinal direction. However, if the tactile engagement service 22 is moved in a lateral direction, the pivot stem 50 and pivot opening 54 restrict the tumbling lever 18 to a rotation about the pivot stem 50. This rotation results in the tactile engagement surface 22 and the detent portion 24 moving in opposite latitudinal directions within the plane of movement 20. This opposed movement is simply the result of the tumbling lever 18 rotating around the pivot stem 50. Please see FIGS. 9, 10, 12, and 13.

The length of movement of each tumbling lever 18 is restricted by the interaction of a pivot stem 50 and the associate with each tactile engagement surface 22. The pivot stem 50 protrudes from the housing 14 and passes through the directional control opening 52 on each tumbling lever 18 and enters a cavity opening 82 in each tactile engagement surface 22. The directional control opening 52 allows the proximal end 46 of each tumbling lever 18 to move in either latitudinal or longitudinal directions within the plane of movement 20. However, the directional control opening 52 restricts the movement of the distal end 48 of each tumbling lever 18 in each of these four distinct directions 56 through the interaction of one of the pivot stems 50 and the directional control opening 52. As seen in FIG. 5, pivot stem 50E penetrates through directional control opening 52D on tumbling lever 18D resulting in the distal end 48 of tumbling lever 18D being restricted to movement in one of the four distinct directions 56. The length of directional control opening 52D in each of the four distinct directions 56 is the controlling factor in the length of movement of tumbling lever 18 in each of the longitudinal directions and the degree of rotation of tumbling lever 18D about pivot stem 50C. In a preferred embodiment of the invention, this movement is approximately one quarter ¼ of an inch in each of the four distinct directions 56.

A key result of controlling the length of movement of the tactile engagement surfaces 22 of each tumbling lever 18 is the manipulation of the detent portion 24 of each tumbling lever 18. The quantitative control of the length of the longitudinal movement of each tumbling lever 18 and the degree of rotation of each tumbling lever 18 within the plane of movement 20 in which each tumbling lever 18 is located corresponds to a detailed manipulation of the detent portion 24 of each associated tumbling lever 18. The correct manipulation of the tactile engagement surface 22 allows the detent portion 24 on each tumbling lever 18 to geometrically align with the locking disc 30 on the connection section 26 of the securing element 16. Once the locking disc 30 and the detent portions 24 are aligned, the releasing mechanism 36 can be activated, thereby allowing the securing element 16 to be ejected from the housing 14. This action releases the item 12 held between the securing element 16 and the housing 14.

In a preferred embodiment, the tactile engagement surfaces 22 on the tumbling levers 18 include a tactile button 74. Each tactile button 74 engages one of the access openings 72 in the housing 14, so that the tactile button penetrates the housing 14. The tactile button 74 allows a human user of the locking device 10 to easily manipulate the tactile engagement surfaces 22 in order to align the detent portion 24 of each tumbling lever 18 with the connection section 26 of the securing element 16.

Also in a preferred embodiment, the tumbling levers 18 include pivot stem openings 76 which allow the pivot stems 50 to pass through the tumbling lever 18 without engaging that particular tumbling lever 18. The pivot stem openings 76 avoid unneeded interaction between the pivot stems 50 and the tumbling levers 18. For example, as seen in FIG. 5, the tumbling lever 18 includes three pivot stem openings 76 which allow the pivot stems 50A, 50B, and 50D to pass through the tumbling lever 18 without engaging the tumbling lever 18.

In order to restrict the movement of the tumbling levers 18 to the individual planes of movement 20 for each respected tumbling lever 18, spacing components 58 are used to retain each tumbling lever 18 in its own plane of movement 20 and separate each tumbling lever 18 from the other planes of movement 20 of the other tumbling levers 18.

In a preferred embodiment, the locking device 10 is adapted to secure a firearm 12, specifically a hand-gun. When the locking device secures a firearm 12, the housing 14 is structurally adapted to conform to a portion of the stock 60 of a fireman 12. In this embodiment of the locking device 10, the securing element 16 includes a holding area 34 adjacent to the housing 14, such that the holding area 34 engages the trigger 62 and trigger guard 64 of the firearm 12 when the locking device 10 is used to secure the firearm 12.

When the locking device 10 is adapted to secure a firearm 12, the locking device 10 includes stabilizers 66, 68, and 70. Stabilizer 66 engages the barrel portion 78 of the firearm 12 and is attached to the securing element 16. Stabilizer 68 is attached to the housing 14 near the location of the attachment between the housing 14 and the releasing mechanism 36 and engages the barrel portion 78 of the firearm 12. Stabilizer 70 is attached to the housing 14 distal from the attachment between the housing 14 and the release mechanism 36. Stabilizer 70 engages the stock 60 of the firearm 12. Stabilizers 66, 68, and 70 are used to maintain a consistent engagement between the locking device 10 and the firearm 12. The stabilizers 66, 68, and 70 make the locking device 10 more tamper resistant and increase the securing characteristics of the locking device 10. In an alternate embodiment, the stabilizers 66, 68, and 70 can be arranged to engage the numerous geometrical shapes that the item 12 could embody.

Locking device 10 can easily be adapted to firearms other than hand-guns. Namely, the locking device 10 can maintain the spirit of the current invention and secure shot guns, rifles, and other forms of firearms. In alternate embodiments of the invention, securing element 16 and the housing 14 can easily be adapted by one skilled in the art to increase the size of the holding area 34, and thus the area of containment 32, to secure items 12 of varying sizes and shapes.

This invention also teaches a method for releasing an item 12 from a locking device 10. The method comprises providing a tactile releasing lock 10 engaging in item 12 and manipulating without visual confirmation the tactile releasing lock 10 to free the item 12.

In the method taught by this invention, the tactile releasing lock 10 includes a plurality of tactile engagement surfaces 22 so that manipulating, without visual confirmation, each tactile engagement surface 22 opens the tactile releasing lock 10. The tactile releasing lock 10 also includes a releasing mechanism 36 which is manipulated, without visual confirmation, to separate the tactile releasing lock 10 from the item 12.

In the method, the tactile releasing lock 10 includes a housing 14, a securing element 16, and a plurality of rods 18 located within the housing 14. The securing element 16 engages the housing 14 such that the item 12 is held between the securing element 16 and housing 14. Also, each rod 18 engages the securing element 16 within the housing 14 and is disengaged from the securing element 16 by manipulation, without visual confirmation, of the tactile engagement surface 22 located on each rod 18. The method then teaches the disengagement of the securing element 16 from the housing 14, thereby disengages the item 12 from both the securing element 16 and the housing 14.

As tactile manipulation of the rod 18A occurs, the tactile engagement surface 22 of the rod 18A is restricted to four distinct directions of movement 56 by the engagement of pivot stem 50B and directional control opening 52A. The four distinct directions 56 are in either the longitudinal or latitudinal directions of rod 18A and plane of movement 20. As the tactile engagement surface 22 located on the distal end 48 of the rod 18A moves in one of the four distinct directions 56, pivot stem 50A, protruding through pivot opening 54A, and pivot stem 50B, protruding through directional control opening 52A restricts the movement of the detent portion 24A of the rod 18A. This restriction results in detailed movement of the detent portion 24A of tumbling lever 18A with respect to locking disc 30A on connection section 26. It is this detailed movement that operates the locking device 10 and allows locking disc 30A on connection section 26 to pass by detent portion 24A, thereby participating in the securing or releasing of securing element 16 from the housing 14.

Pivot stem 50B is also used to guide tumbling lever 18B. Pivot stem 50B enters pivot opening 54B on rod 18B and pivot stem 50C enters directional control opening 52B on rod 18B. Once again as tactile manipulation of tumbling lever 18B occurs in one of the four distinct directions of movement 56 for tumbling lever 18B, pivot stems 50B and 50C, pivot opening 54B and directional control opening 52B control the movement of detent portion 24B on rod 18B by restricting rod 18B to either longitudinal or rotational movement within plane of movement 20 for rod 18B. Once again it is this detailed manipulation that controls the engagement between locking disc 30B on connection section 26 and the detent portion 24B on rod 18B and allows locking disc 30B to pass by detent portion 24B, thereby participating in the securing or releasing of securing element 16 from the housing 14.

This pattern continues for rods 18C and 18D with associated pivot stems 50B, 50C, 50D, and 50E, pivot openings 54C and 54D, and directional control openings 52C and 52D. For example, as the proximal end 46 of rod 18C is located between locking disc 30B and 30C on connection section 26, pivot stem 50C penetrates pivot opening 54C, while pivot stem 50D penetrates directional control opening 52C on rod 18C. As manipulation of the tactile engagement surface 22 on rod 18B occurs, rod 18B traverses the plane of movement 20 in order to disengage the detent portion 24B of rod 18B from securing element 16.

The method taught by this invention further includes a human user of the locking device 10 releasing the item 12 from the locking device 10 after the rods 18 are manipulated to allow the securing element 16 to disengage from the housing 14. Once this manipulation has occurred, the human user presses the releasing mechanism 36, which in turn forces the contact portion 42 of the releasing mechanism 36 to push connection section 26 of the securing element 16 out of the housing 14. This allows the securing element 16 to disengage from the item 12, thereby allowing the locking device 10 to fall from the item 12. In a preferred embodiment, the human user uses the index finger to activate the releasing mechanism 36 to accomplish the aforementioned task. Once the human user has released the item 12 from the securing member 16, the human user can remove his index finger from the releasing mechanism 36 and allow the housing 14 to fall from the item 12.

Thus, it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

The invention claimed is:

1. A method for releasing an item from a locking device, the method comprising:

(a) providing a tactile releasing lock engaging the item, the tactile releasing lock including a plurality of tactile engagement surfaces positioned within a plane;

(b) without visual confirmation, manipulating by direct contact with the fingers of the hand the tactile engagement surfaces of the tactile releasing lock in multiple intersecting directions within the plane to free the item; and step (b) further including manipulating, without visual confirmation, a first tactile engagement surface in a first direction, a second tactile engagement surface in a second direction intersecting the first direction, and a third tactile engagement surface in a third direction intersecting one of the first or second directions, to open the tactile releasing lock.

2. The method of claim 1, wherein:

in step (a) the tactile releasing lock includes a releasing mechanism; and step (b) further includes manipulating, without visual confirmation, the releasing mechanism, thereby separating the tactile releasing lock from the item.

3. The method of claim 1, wherein:

in step (a) the tactile releasing lock includes a housing, a securing element, and a plurality of rods located within the housing, the securing element engaging the housing, the item being held between the securing element and the housing, each rod engaging the securing element, and each rod including one of the tactile engagement surfaces; and step (b) further includes:

(b)(1) manipulating, without visual confirmation, the tactile engagement surface located on each rod to disengage said rods from the securing element;

(b)(2) disengaging the securing element from the housing; and (b)(3) disengaging the item from the securing element and the housing.

4. The method of claim 3, wherein step (b)(1) further includes manipulating the tactile engagement surface in one of four distinct directions to disengage said rods from the securing element.

5. The method of claim 1, wherein step (b) further includes planar manipulation of the plurality of tactile engagement surfaces, without visual confirmation, in one of four distinct directions to free the item.

6. A method for releasing an item from a locking device, the method comprising:

(a) providing a tactile releasing lock engaging the item, the tactile releasing lock including a plurality of tactile engagement surfaces, a housing, a securing element, and a plurality of rods located within the housing, the securing element engaging the housing, the item being held between the securing element and the housing, each rod engaging the securing element, and each rod including one of the tactile engagement surfaces;

(b) manipulating, without visual confirmation, the tactile engagement surface located on each rod in one of four distinct directions within a plane to disengage said rods from the securing element;

step (b) further including manipulating, without visual confirmation, a first tactile engagement surface in a first direction, a second tactile engagement surface in a second direction intersecting the first direction, a third tactile engagement surface in a third direction intersecting one of the first or second directions, and a fourth tactile engagement surface in a fourth direction intersecting one of the first or second directions to open the tactile releasing lock;

(c) disengaging the securing element from the housing; and (d) disengaging the item from the securing element and the housing.

7. A method for releasing an item from a locking device, the method comprising:

(a) providing a tactile releasing lock engaging the item, the tactile releasing lock including a plurality of tactile engagement surfaces positioned within a plane, a housing, a securing element, and a plurality of rods located within the housing, the securing element engaging the housing, the item being held between the securing element and the housing, each rod engaging the securing element, and each rod including one of the tactile engagement surfaces;

(b) without visual confirmation, manipulating each tactile engagement surface of the tactile releasing lock in multiple intersecting directions within the plane to free the item, including manipulating, without visual confirmation, the tactile engagement surface located on each rod to disengage said rods from the securing element, disengaging the securing element from the housing, and disengaging the item from the securing element and the housing; and step (b) further including manipulating, without visual confirmation, a first tactile engagement surface in a first direction, a second tactile engagement surface in a second direction intersecting the first direction, and a third tactile engagement surface in a third direction intersecting one of the first or second directions, to open the tactile releasing lock.

8. The method of claim 7, wherein:

in step (a) the tactile releasing lock includes a releasing mechanism; and step (b) further includes manipulating, without visual confirmation, the releasing mechanism, thereby separating the tactile releasing lock from the item.

9. The method of claim 7, wherein step (b) further includes manipulating the tactile engagement surface in one of four distinct directions to disengage said rods from the securing element.

10. The method of claim 7, wherein step (b) further includes planar manipulation of the plurality of tactile engagement surfaces, without visual confirmation, in one of four distinct directions to free the item.

* * * * *